US005964346A

United States Patent [19]

O'Connor

[11] Patent Number: 5,964,346

[45] Date of Patent: Oct. 12, 1999

[54] GOLF CLUB ORGANIZER

[76] Inventor: James C. O'Connor, 102 Deer Park Close, Franklin, Tenn. 37069

[21] Appl. No.: 09/062,913

[22] Filed: Apr. 20, 1998

Related U.S. Application Data

[60] Provisional application No. 60/040,467, Apr. 21, 1997.

[51] Int. Cl.[6] ..... A63B 55/00; A63B 57/00

[52] U.S. Cl. ..... 206/315.6; 206/315.2; 211/70.2

[58] Field of Search ..... 206/315.2–315.6; 211/70.2

[56] References Cited

U.S. PATENT DOCUMENTS

| | | | |
|---|---|---|---|
| 1,756,902 | 4/1930 | Boyce | 206/315.6 |
| 2,436,687 | 2/1948 | Corbett | 206/315.6 |
| 2,520,226 | 8/1950 | Smith | 206/315.4 X |
| 3,503,518 | 3/1970 | Black | 206/315.6 X |
| 4,100,652 | 7/1978 | Carlson | 206/315.3 X |
| 4,960,212 | 10/1990 | Wu | 211/70.2 |
| 5,029,703 | 7/1991 | Dulyea, Sr. | 206/315.3 |
| 5,383,555 | 1/1995 | Weinmeier | 206/315.6 |
| 5,617,951 | 4/1997 | Wick | 206/315.6 |
| 5,620,091 | 4/1997 | Larson | 206/315.6 |
| 5,755,322 | 5/1998 | Yang | 206/315.6 X |
| 5,779,043 | 7/1998 | Hsu et al. | 206/315.6 |
| 5,803,252 | 9/1998 | Huo-Chuan | 206/315.6 |
| 5,816,397 | 10/1998 | Pratt | 206/315.6 |

*Primary Examiner*—Sue A. Weaver
*Attorney, Agent, or Firm*—Charles W. Chandler

[57] ABSTRACT

Golf clubs can be suspended within a golf bag by the use of an add-on club holder releasably attached to the upper edge of a conventional golf bag. The club holder can include an elongated bendable strip having a number of supporting clamps spaced along the strip lower edge to grip the upper edge of the bag. The strip is bendable to conform to the shape of the bag perimeter edge. Heads of the golf clubs can be positioned in slots in the upper edge of the bendable strip. Each slot is aligned with a cantilever finger extending from the elongated strip so that the finger prevents the head of the golf club from slipping out of the slot.

10 Claims, 5 Drawing Sheets

GOLF CLUB ORGANIZER

CROSS-REFERENCE TO RELATED PATENT APPLICATION

This application is a continuation-in-part of my Provisional Patent Application No. 60/040,467-filed Apr. 21, 1997.

BACKGROUND AND SUMMARY OF THE INVENTION

This invention relates to a golf club organizer installable in a golf bag for supporting and separating the golf club irons in an orderly and organized fashion. The organizer is designed to overcome some disadvantages of golf club supporting devices heretofore used.

U.S. Pat. No. 4,960,212, issued to C. S. Wu, discloses a main frame for holding seven golf clubs in a golf bag, and an auxiliary frame for holding two additional golf clubs. The main frame extends across the diameter of the golf bag, and the auxiliary frame is swingably attached to a side surface of the golf bag so that it can be located above the bar or outwardly beyond one edge of the bag. Each frame is secured to the golf bag by attachment screws. The club holders in each frame form V-shaped slots designed to grip the front and rear faces of a golf club.

U.S. Pat. No. 5,029,703, issued to K. Dulyea, shows a golf bag organizer that includes an annular ring member secured in the mouth of a golf bag, with inwardly-directed gripper fingers adapted to grip the shafts of golf clubs placed in the golf bag. A lock ring is carried by the annular ring for locking the club shafts against removal from the bag, e.g. when it is desired to transport the bag in the trunk of an automobile. A base having a series of upwardly-facing sockets is positioned in the bottom of the golf bag to stabilize the butt ends of the club shafts against shifting or undesired angulation.

Quick access to the clubs is paramount on today's golf courses since time management has become the priority. Signs are posted at every hole telling the players how much time should be used for each hole. Under these circumstances, access and identification of the clubs can become an essential time saver. Many times clubs are hidden in the bag by the wood covers, or the shorter clubs used as the player approaches the hole, are hidden by the longer irons and/or under the cloth wood covers.

This invention solves the above mentioned problems by displaying all of the irons. The iron club heads are cradled outside the bag opening in numerical order away from the woods. Every iron is held firmly to the inner perimeter wall of the golf bag opening allowing the iron head to protrude out over the periphery of the bag in a fan like array for easy identification. Each iron can be quickly accessed, extracted, and replaced during use.

U.S. Pat. Nos. 5,617,951 issued to Philip B. Wich, Apr. 8, 1997, and 4,960,212, issued to Chun S. Wu, Oct. 2, 1990, disclose organizers to fit most bags because they mount directly across the center of a bag. However, they can carry no more than seven iron clubs. The center mount causes access problems for shorter irons such as the wedges and putter since the irons heads in the holders hang over the space in which these shorter irons are stored. Both of the structures shown in these patents use alligator clamps to attach the structures to a golf bag opening. These prior art devices comprise multiple parts, e.g., a mainframe, an adjustment leg, and various nuts and bolts.

U.S. Pat. No. 5,383,555, issued to Robert J. Weinmeier, Jan. 24, 1995, uses the periphery of a bag for the irons, but is separated in two by a frame work that takes up the entire bag opening. There is no allowance for the variety of clubs golfers use today, such as chipping irons, lob wedges, long 5 foot putters, ball retrievers, etc.

The prior art club-supporting devices are commonly designed to fit particular golf bag shapes, e.g. round or oval. My golf club organizer or holder is designed to fit a variety of different golf bag shapes, e.g. round, oval, oblong, etc.

One disadvantage of many prior art golf club holders is that the club support has to be permanently affixed to the golf bag. I have designed a golf club holder that can be removably attached to a range of different style golf bags. The golf club holder can be readily removed from one golf bag and mounted on another bag quickly without special tools.

A special feature of my invention is that the golf clubs are arranged around the perimeter of the bag, with the club heads extending outwardly beyond the edge of the bag. A large central space is provided for the other wood clubs. Also, with my golf club holder a relatively large number of golf clubs can be supported in a relatively small size bag. The bag cost, size and weight can be minimized.

The golf club holder of the present invention preferably comprises a bendable upright plastic strip having four downwardly extending legs adapted to grip the upper edge of a golf bag, whereby the plastic strip extends directly above the upper edge of the bag. The plastic strip can be bent into various configurations, to follow the curvature of different bag shapes, e.g. round, oval, oblong, etc.

The plastic strip has its major face area extending vertically so as to have considerable strength in the vertical plane. Upper edge areas of the plastic strip are grooved and offset from the strip major plane, to form angular slots and offset fingers. A golf club iron can be supported in an inverted position in each angular slot, so that the head of the club extends transversely through the slot, and the heel of the club seats against an associated offset finger. The club head is prevented from shifting upward or horizontally out of the slot, whereby the club is retained against dislocation from the carrier (plastic strip). Each slot is angulated so that the golfer can readily insert or remove a golf club by a lateral motion of the club into or out of the space provided by the offset finger.

The slots in the holder are designed to prevent the clubs from vibrating out of the slots when the golf bag is mounted on a motorized golf cart or on a pull cart. Preferably the holder is located a sufficient distance above the mouth of the golf bag so that the golf club irons hang freely from the holder. This allows the shafts and grip areas of the clubs to normally hang straight down in the bag alongside the bag side wall. The club shafts tend to be separated from each other, to avoid damage caused by one club striking another club. The disposition of the iron clubs proximate to the side wall of the bag leaves a relatively large open central space in the bag that can be used to house the wood clubs, ball retrievers, umbrellas, or other specialties.

The downwardly-extending legs used to mount the golf club holder on the golf bag have integral outwardly facing gripper fingers designed to grip the shafts of certain specialty clubs that may be too short for easy access in the golf bag, e.g. the putter, the lob wedge and the chipping iron. Such gripper fingers can be used for gripping and supporting other devices associated with the game of golf, e.g. attachment rings for towels, water bottles, shoe brushes, ball washers, and club or spike cleaning tools.

Preferably the golf club holder is manufactured and packaged in a flat condition. This is advantageous from a manufacturing standpoint and also from a sales point of view, since the package takes up a relatively small space on the shelf or in a suspended display position.

A golf club organizer of the present invention will support eleven iron clubs including the putter and any other special iron such as a chipping iron, or extra wedges. It also leaves ample room in the bag opening for other clubs that are not mentioned.

Nine iron clubs will be firmly stored in specially designed holding pockets. They can be kept in numerical order around the perimeter of the golf bag opening with the club heads protruding out over the periphery of the bag to display each in a fan like array.

The iron club shafts within the bag are kept close to the inner circumference on the golf bag interior. They hang freely avoiding damage to each other, and at a proper height above the bottom of the bag to avoid bottoming out.

The golf club organizer of the present invention is molded flat as a one piece plastic molding, with adequate flexibility to have a 7 inch through 10 inch diameter semi-circle configuration adaptable to 7 to 10 inch golf bag openings.

The specially designed holding pockets are formed to hold the various shaped iron club heads on the market today with few exceptions. The two exterior club hangers are used to carry the putter and any other specialty club a golfer uses most frequently during the game. These two clubs are completely outside of the bag and are quickly accessed by simply pulling up on them. When not in use, these clubs are stored in the golf bag.

The golf club carrier of this invention has four (4) integral clip type leg supports that attach over the lip of a golf bag opening simply by slipping over the lip without undue friction or abrasion. These legs serve to hold the main frame upright and do not have to grip the bag since the curved flexible main frame, which assumes the diameter of the bag opening, will produce the force to hold it in position. Once the iron clubs are loaded into the plurality of holding pockets, the weight of the irons adds to the stability of the organizer.

These four clip legs are reinforced along their vertical axis to form a solid upright structure ready for the repeated abuse of the irons being extracted and replaced many times per game. The combination of the curved main frame flexibility and four reinforced clip legs insures this product will not shift, tip over, or become dislodged once placed on the golf bag.

Further features of the invention will be apparent from the attached drawings and description of an illustrative embodiment of the invention.

DESCRIPTION OF THE DRAWINGS

The description refers to the accompanying drawings in which like reference characters refer to like parts, throughout the several views, and in which.

DESCRIPTION OF A PREFERRED EMBODIMENT OF THE INVENTION

Figure 1:
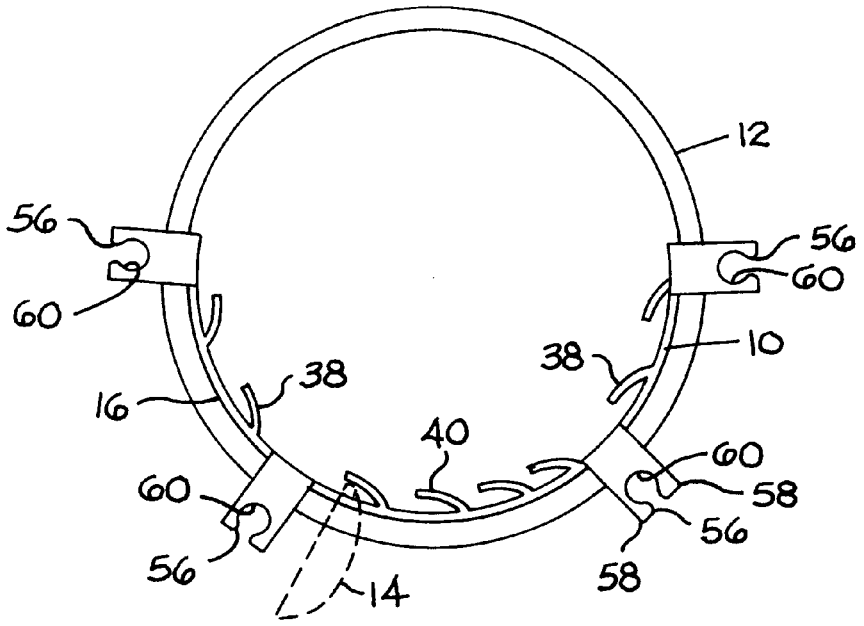
FIG. 1 is a top plan view of a golf bag equipped with a golf club holder of the present invention.
Figure 2:
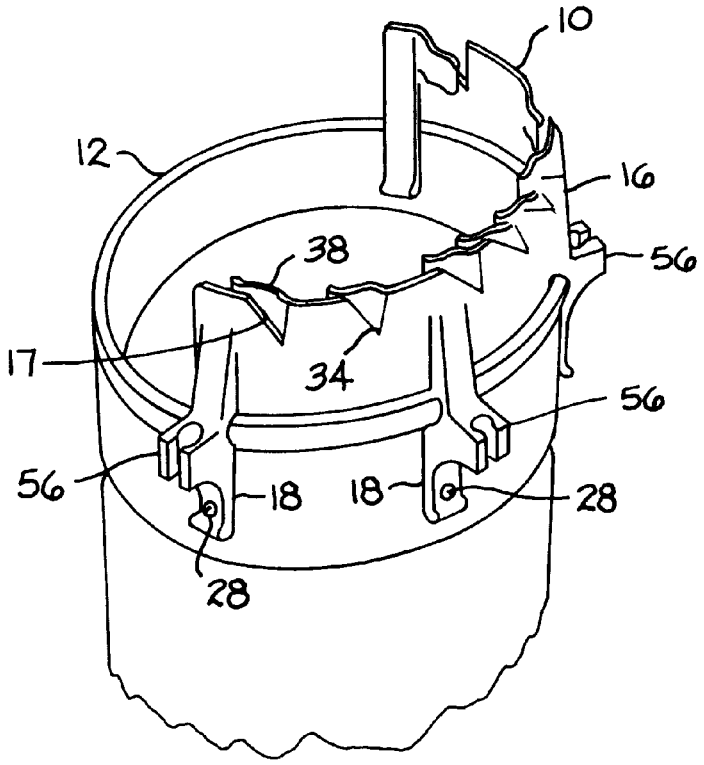
FIG. 2 is a fragmentary perspective view of the FIG. 1 golf bag and holder.

FIGS. 1 through 5, show a golf club carrier constructed according to the present invention. The golf club carrier (or holder) 10 is shown in an installed position on a conventional golf bag 12 having a circular shape. The FIG. 1 golf club holder can be used on golf bags having other shapes, e.g. round, oval or oblong. The club holder (or organizer) 10 is formed of a bendable plastic material to conform to different golf bag configurations.

Golf club holder 10 is designed to support the so-called iron clubs; the wood clubs occupy the central space not occupied by holder 10. A representative iron golf club 14 supported by holder 10 is shown in phantom in FIG. 4. Holder 10 is designed so that the golf clubs are disposed in the inverted positions in bag 12, with the club heads 15 overhanging the upper outer edge of the bag, and with the club shafts extending downwardly within the bag interior space.

Holder 10 preferably comprises a relatively thin flat plastic strip 16 and four sets of integral vertical grippers 18 extending downwardly from the strip at spaced points along the length of the strip. Each set of grippers (or clamps) comprises an inner leg 20 (FIG. 4) and an outer leg 22 spaced so that the two legs extend downwardly along the inner and outer surfaces of the golf bag to mount holder 10 on the mouth of the bag. Preferably, legs 20 and 22 have a sufficient length that plastic strip 16 extends in a vertical plane spaced some distance above the edge 26 of the bag mouth. The two end grippers 18 are heavier than the two middle grippers 18 to avoid flexing under the weight of the irons when the bag is in motion.

Legs 20 and 22 are somewhat resilient so as to be capable of spreading apart slightly, to slip down over the upper edge of the golf bag. A set screw 28 is threadably connected to each outer leg 22, to exert a clamp force on the outer surface of the golf bag if necessary. The holder can be mounted on any bag configuration, due to the resilient bendable nature of plastic strip 16.

Figure 3:
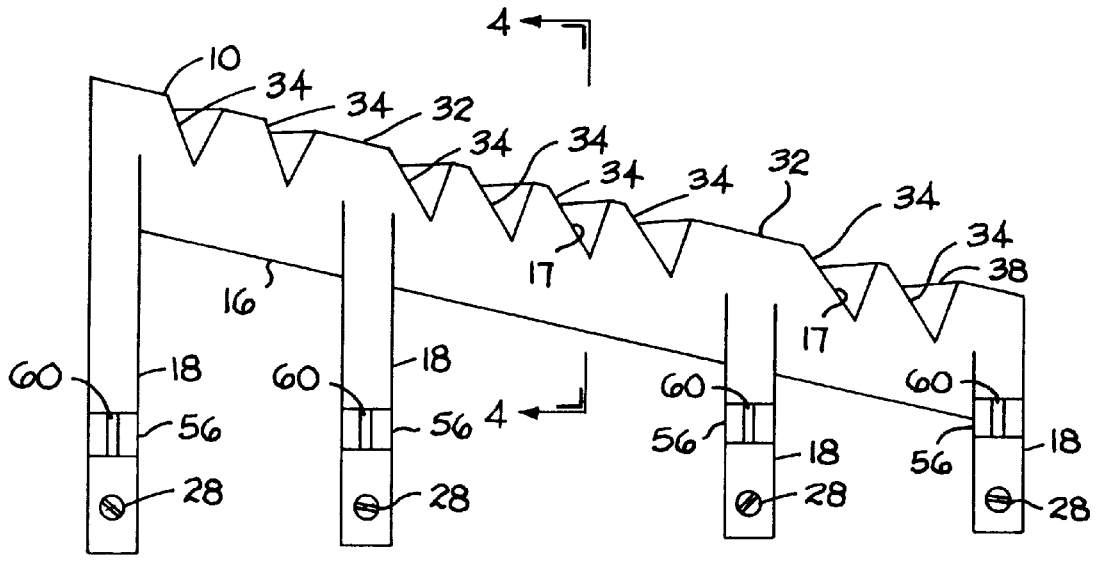
FIG. 3 is an enlarged plan view of the FIG. 1 golf club holder in its manufactured flat state showing the vertical legs that support the holder in the golf bag.
Figure 4:
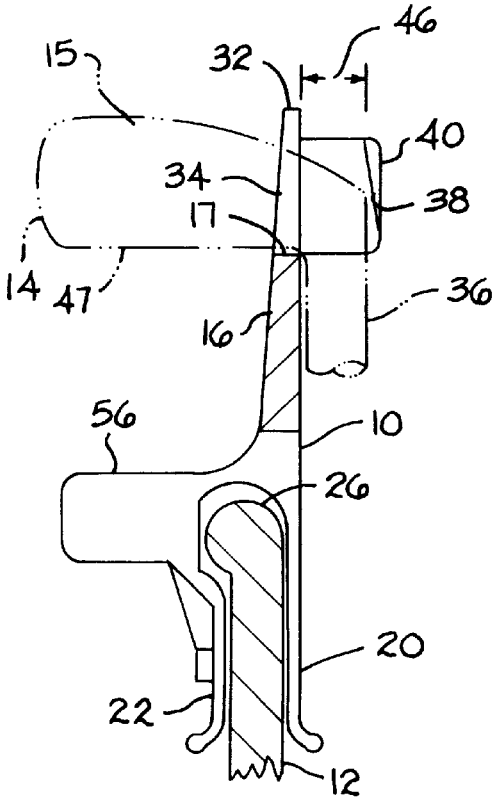
FIG. 4 is an enlarged transverse sectional view taken on line 4—4 in FIG. 3.

Plastic strip 16 has an upper edge 32 having eight angular slots 34 therein, as shown in FIG. 3. Each slot 34 provides an edge surface 17 that is adapted to support and position one golf club. FIG. 4 shows a representative golf club 14 in its supported position; the ball-striking head of the club extends transversely through slot 34. Shaft 36 of the club extends downwardly from the head alongside the inner side surface of golf bag 12.

Figure 5:
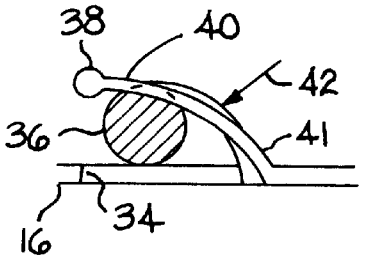
FIG. 5 is an enlarged view of a typical club supporting finger.

Each angular slot 34 is aligned with a cantilever finger 38 that includes a upper wall 40. Referring to FIG. 5, the upper face of a typical finger is curved inwardly as shown by arrow 42 to capture the heel of the club head 15. Wall area 40 is offset from the major plane of strip 16 by an offset distance 46 that is approximately the same as the diameter of club shaft 36. Each cantilever finger 38 comprises a neck portion 41 joining offset portion 40 to strip 16.

The fingers are sloped downwardly, from left to right, as shown in FIG. 3, to provide access to each club.

Wall 40 is spaced from the major plane of strip 16 so that the club can be installed into slot 34 by moving club shaft 36 against wall 40 (in FIG. 4), and then allowing lower edge area 47 of the club head to slide down along finger 38 until the club head rests in the bottom of the slot.

FIG. 4 shows the golf club in its final supported position. Finger 38 prevents the club from vibrating or otherwise moving out of slot 34. Each slot 34 and associated finger 38 forms a pocket structure for supporting one golf club.

Strip 16 is preferably located a sufficient distance above the golf bag that the golf clubs are suspended from the holder, rather than being supported by the floor of the golf bag. The shaft portions of the golf clubs hang freely in near proximity to the inner surface of the bag side wall. Strip 16 is in a vertical plane so that its major plane is in the direction of the load imposed by the club heads.

As an optional feature, each set of grippers 18 includes an outwardly directed channel structure 56. As shown in FIG. 1, the channel structure has two spaced flanges 58 having arcuate facing surfaces that form a generally cylindrical cavity 60. Cavity 60 has a preferred diameter that corresponds approximately to the diameter of the shaft of a conventional putter, wedge, or other special club that the golfer uses for a large number of shots.

The golfer can place the shaft of the special club against the ends of flanges 58 and move the shaft into cavity 60, whereby the special club is supported head down by the channel structure.

Flanges 58 are preferably resilient to permit easy insertion of the special club shaft into or out of the channel by raising or lowering the club shaft. The advantages of each channel structure 56 is that the club is readily accessible. The golfer doesn't have to pull the club out of the golf bag or insert the club into the golf bag.

Each channel structure 56 constitutes a resilient clip means that can be used to support other devices, e.g. a ring or pin carrying a towel, water bottle, or shoe brush, etc.

The perimeter mounting feature of this golf club holder is a prime difference between this holder and any other similar purpose holder.

The perimeter design takes advantage of any golf bag's full capacity, instead of just using the diameter dimension across the center of the golf bag.

This invention allows the irons to hang over the outer periphery of a golf bag in an equally spaced and visible numerical fashion so they are easily identified and quickly accessed for play.

The design of the slots or grooves that hold the irons guarantees that each club will stay in its designated slot without working out and falling loosely in the bag. This firm retention is accomplished by the design of the slot itself in which a combination of angular turns that permit the iron "heel" to rest against a stop or wall 40 that will not allow the iron to back-out of its designated position.

At the same time, the offset disposition of the stop permits easy removal of the iron and easy replacement when the golfer is through using it.

Slots 34 are so designed as to eliminate any of the clubs from vibrating out of the designated slots while the clubs are mounted on a motorized golf cart or on a pull cart.

This invention of a perimeter mounted iron holder takes advantage of the space at the bottom of a golf bag much more effectively. The irons hang freely in the bag unobstructed by the golf grips and shafts.

Center loaded bags, which are very common today, tend to allow the shafts and grips to bind heavily on each other. At times they seem to interlock so as to potentially cause damage to the shafts or grips.

The elevated holder strip 16 allows the irons to hang freely, which allows the grip and shaft to find their own resting place, normally with the shaft straight down in the bag. There is definitely more room around the perimeter of a golf bag than across its diameter, which in itself is a major improvement over existing iron stackers or organizers on the market today.

Four support grippers 18 allow attachment to all golf bags. Each gripper leg set provides structural support to the slim, very flexible plastic rack circling the bag perimeter. Incorporated into each set of gripper legs is a utility club socket or channel adapted to carry a putter, "L" wedge, chipping iron, etc. Pins can be provided to hold towels, bottles, shoe brushes, ball washers, etc.

When a putter is carried in the socket or channel, the grip will protrude above the irons slightly to allow quick access at every hole. The same reasoning is applied to an "L" wedge or chipping iron. The special club is held in place by the gradually increasing diameter of the shafts of these special clubs. The peripheral mounting of these sockets gives very quick access to all special or often used clubs, such as a putter, etc.

The entire holder is one solid piece of plastic molded from a single die. It will be marketed laying flat. This enables economical packaging and shipping, and maximizes box count and display capabilities.

Specific plastics will be used to provide the necessary vertical strength required to support all of the irons. The four grippers 18 enhance the strength against constant use by the golfer.

The gripper legs can be reinforced where the head of each club rests in each slot. Reinforcing also at the portion of the slot that retains the heel of each club can also enhance the retentive action, stopping the clubs from backing out of the assigned slots.

Retention will be so positive that if the golf bag is picked up from the non-handle side of the golf bag, the clubs will stay in their respective slots.

Perpendicular reinforcement ribs can enhance each club slot to avoid extreme shock due to the golf bag being dropped or jostled roughly.

The four sets of gripper legs 18 snap down over the lip of the golf bag's open end. This feature allows the golfer to adjust the holder to fit correctly in conjunction with any and all horizontal cross bars or spacers located in any type or make of golf bag. The flexibility of this invention allows the user to actually "stretch" the slotted portion to help avoid the spacers in golf bags. The stretching cantilevers the holder inward which suspends the club shafts freely in the bag.

Where the lip of a golf bag may be relatively thin around the upper most edge, as manufactured in less expensive bags, set screws 28 may be used to secure the holder to the body of that type of golf bag lip.

Slots 34 are separated at points on the perimeter of the holder to allow space for the utility club sockets 56 to carry special clubs such as the putter, chipping iron, "L" wedge, etc. outside the golf bag periphery without interfering with the clubs hanging inside the golf bag.

Holder strip 16 can be purposely made thin to accomplish two important features: 1. so that the holder can conform to any shape golf bag open end whether it is round, oval, oblong or other unusual shape, and 2. so that the holder can be laid flat when not in use or when it is packaged to be sold or shipped.

Special plastic polymers will assure strength along with the specific reinforcement previously mentioned.

Figure 6:
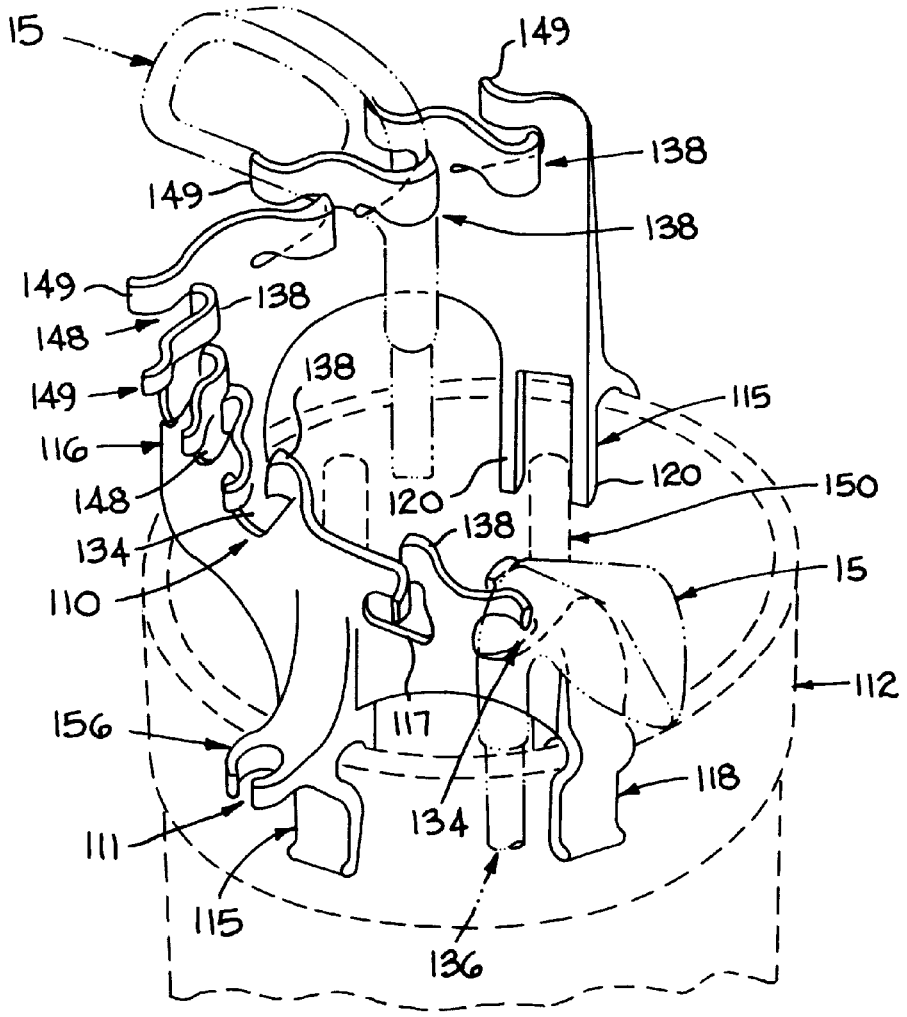
FIG. 6 is a perspective view of another golf club organizer embodying the invention, the associated golf bag and two iron clubs are shown in dashed lines.

FIGS. 6 through 11 show another preferred embodiment of the invention. Perspective view FIG. 6 shows club holder 110 attached to golf bag 112 by two midddle leg clips (or clamps) 115 and two end leg clips 118. Middle clips 115 are equipped with exterior club hangers 156 that will carry the putter, either on the right side or left side of golf bag 112, depending on which side of the golf motorized cart the participant is sitting. Exterior club hanger 156 has an opening so that the shaft of said putter or any other desired club can be hung outside the bag for quick access during the game. This opening is as shown at 111 on the accompanying drawings.

The main plastic frame 116 has nine pockets 148 formed by fingers 138 molded and shaped along the upper edge of the main frame 116. These holding pockets are shaped to hold the iron club heads 15. Each pocket holds the heel of the golf iron preventing the irons from falling backward into the bag 112 opening. The guide angle edge 117 on each angular slot 134 serves two purposes; it holds the irons from moving out of the pocket at its open end. Secondly, it allows easy extraction of any golf iron, and it also allows easy guidance back into the pocket.

Each pocket 148 is formed by a slot 134 in the plane of the main plastic strip 116, a cantilever finger 138 extending angularly from the plane of plastic strip 116 above the opening in golf bag 112, and a second finger 149 extending angularly from plastic strip 116 away from the associated finger 138. Each finger 149 is adapted to engage the front face of the associated golf club head 115A proximate to the club shaft, so that all of the club heads extend outwardly in generally parallel row-like fashion.

The structure of each pocket 148 provides space for a variety of different style iron club designs, from regular straight back clubs through the popular offset back clubs. Support edge 117 acts as the seat or rest for all of the iron clubs around the periphery of the mainframe, and maintains the fan-like array that displays the iron clubs to the user.

Figure 11:
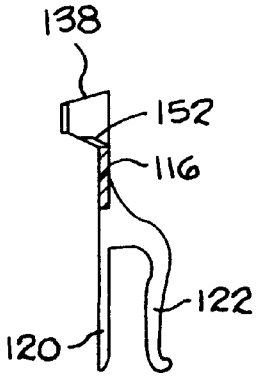
FIG. 11 is a sectional view taken on line 11—11 in FIG. 9.
Figure 10:
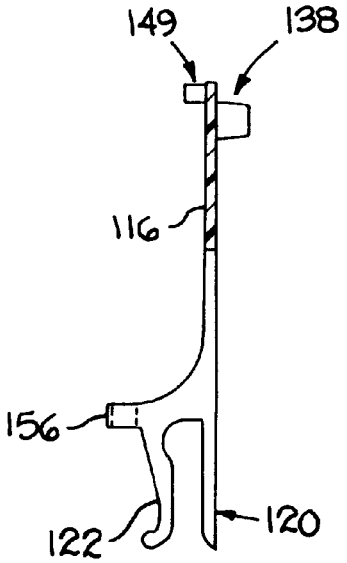
FIG. 10 is a sectional view taken on line 10—10 in FIG. 9.

Support edge 117 directs the weight of the iron clubs directly on the main frame vertical axis. In doing so, iron shafts 136 are guided to hang straight down the inner wall of the golf bag opening, thus avoiding tangling with each other inside golf bag 112. The sets of four leg clips (clamps) 115 and 118 form a balanced frame around the perimeter of most golf bags 112, whether the golf bag is round, oval, or oblong. These four sets of legs are shaped to clip over the open end of a golf bag without damaging the bag surface. As shown in FIG. 11, a representative clamp comprises an inner leg 120 and an outer leg 122 spaced apart to engage the bag inner surface and outer surface, respectively.

The inner part of the four clip legs have been formed as two prongs 120. This design serves two purposes. First, this shape allows the molding die to have access to the inner portion of the clip legs, secondly, this prong shape allows the holder 110 to be rotated slightly around the golf bag upper edge, which provides space for avoiding interference from the golf bag dividers 150. This is necessary since all golf bags are not made the same inside. Some adjustment is necessary to fit all makes of golf bags.

Figure 7:
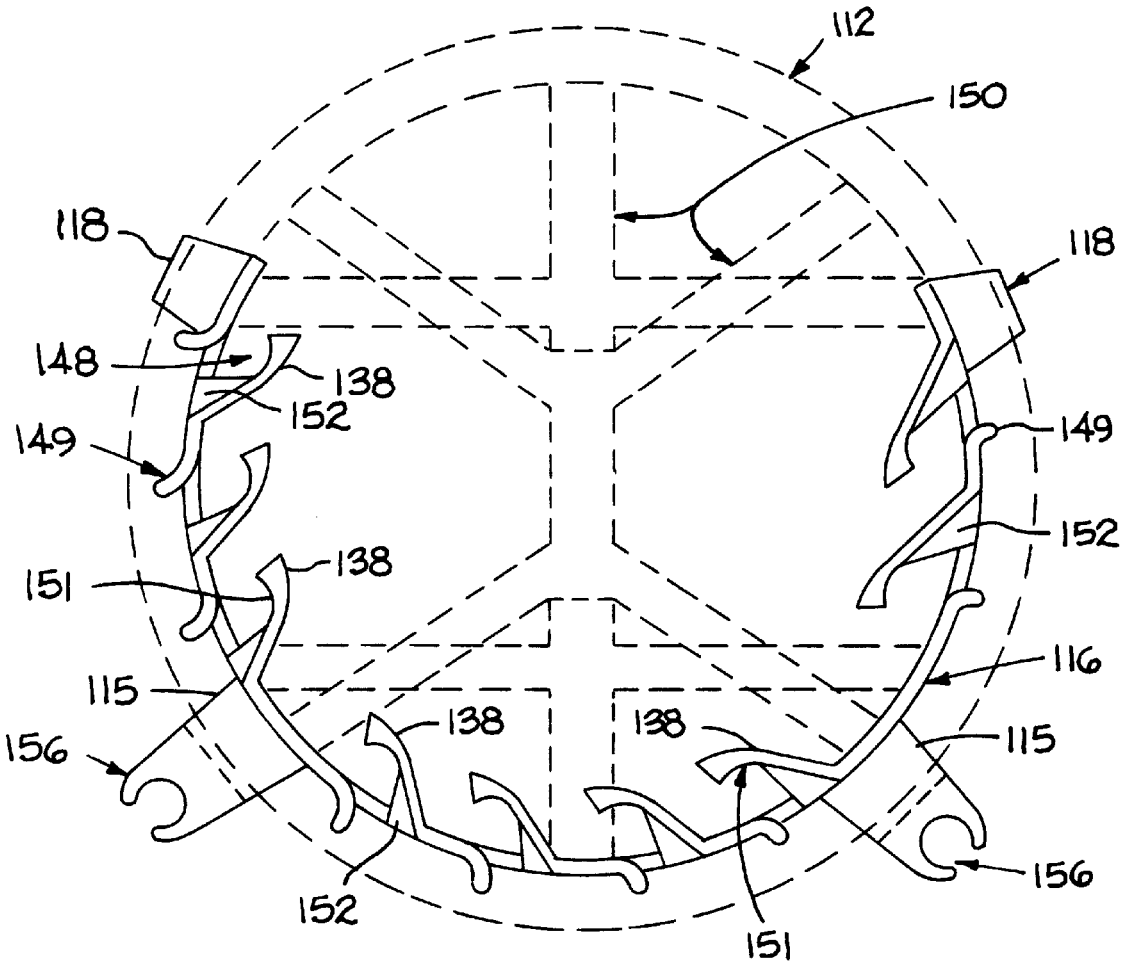
FIG. 7 is a top plan view of the golf club organizer depicted in FIG. 6.
Figure 9:
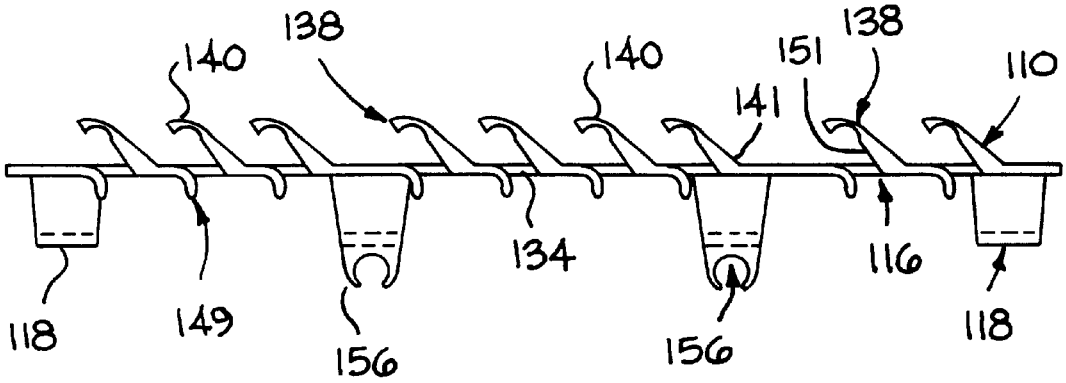
FIG. 9 is an end view of the FIG. 8 golf club organizer taken in the direction of arrow 9 in FIG. 8.
Figure 8:
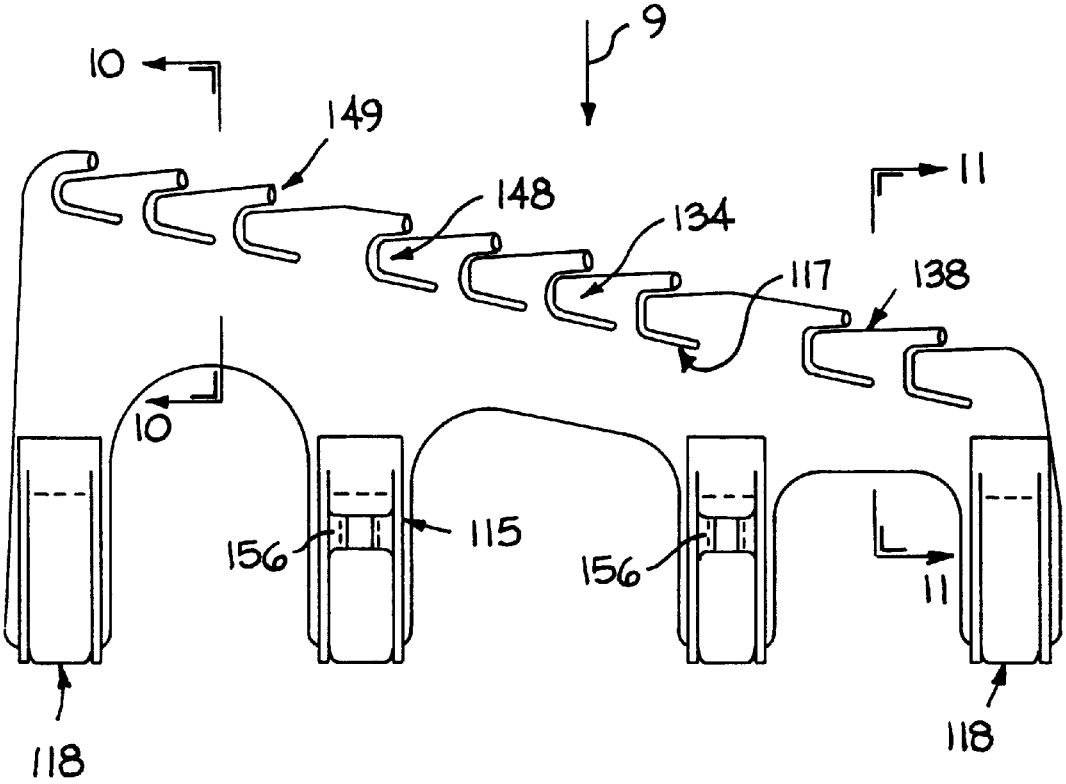
FIG. 8 is a plan view of the FIG. 6 golf club organizer laid flat for shipment, storage or display in a suitable package.

As shown in FIG. 7, the iron club organizer is flexed to fit the diameter of most golf bags. Golf bags can range from 7 inch diameter to 10 inch diameter. This iron organizer will flex to fit that range of golf bag openings, or any bag that has a diameter as part of its open end, such as, oval, oblong, etc.

The mainframe 116 has nine holding pockets that contain each iron club separately and in numerical order around the golf bag perimeter. Each finger 149 lets the iron club face rest against it when not in use. Each finger 149 also helps hold the golf club and stops any movement from side to side, preventing the golf clubs from colliding with each other while the bag is in motion.

Surface 151 on each finger 138 engages the heel of each iron club to prevent the iron from falling back into the golf bag in a haphazard maze. The irons are held firmly to the inner perimeter of the golf bag and are kept from rattling against other shafts 136.

Pockets 148 are constructed to accept the multiple styles of iron clubs on the market today. These styles range from the offset shaft style to the straight shaft style used many years ago. This space on main frame 116 will only change appearance as to how the irons fan out around the periphery of the golf bag.

The cantilever finger 138 at each holding pocket opening is positioned to receive the iron shaft 136 as it is put into the golf bag. It provides easy extraction and reception of the golf club. As shown in FIG. 7 of the drawings, each finger 138 is offset from the plane of plastic strip 116 to provide a space for accommodating the shaft of the golf club; fingers 138 prevent the golf club from falling out of its supported position resting on edge surface 117. Each finger 138 comprises a wall 140 offset from bendable strip 116 and a neck portion 141 joining wall 140 to strip 1 16 to form the club head=receiving pocket 148. Each finger 138 has a flange 152 extending along its lower edge for stiffening purposes.

Having described my invention, I claim:

1. A golf club holder comprising an elongated bendable plastic strip having an upper edge and a lower edge, and means for mounting said bendable strip above the perimeter edge surface of a golf bag; said mounting means comprising individual clamps spaced along the lower edge of said plastic strip to grip the bag perimeter edge surface, whereby said clamps collectively cause said strip to bend so as to conform to the golf bag edge surface; said plastic strip having a series of slots in said upper edge, each of said slots being adapted to support the head of a golf club, with the club shaft depending into the golf bag; said elongated plastic strip having an inner surface adapted to face the area above the golf bag, and an outer surface adapted to face away from the golf bag; and a series of fingers extending angularly away from the inner surface of said elongated strip in alignment with said slots, so that said fingers prevent the golf club heads from slipping out of said slots.

2. The golf club holder of claim 1, wherein each of said fingers has a cantilever connection to said elongated strip.

3. The golf club holder of claim 1, wherein each of said clamps comprises a resilient inner leg means adapted to engage the inner surface of a golf bag, and a resilient outer leg means adapted to engage the outer surface of a golf bag.

4. The golf club holder of claim 1, and further comprising a series of additional fingers extending angularly from the outer surface of said elongated strip away from said first mentioned fingers to engage the front faces of golf club heads positioned in said slots.

5. A golf club organizer adapted to be mounted on a golf bag, comprising:

a bendable elongated flat strip adapted for disposition above the upper edge of a golf bag; mounting means extending from said strip for engagement with an upper edge of a golf bag so that said bendable strip can have its major plane conforming to the contour of the bag upper edge; a series of golf head retention pockets spaced along said elongated strip;

said mounting means comprising plural bag-grippers spaced along said bendable elongated strip; each of said bag-grippers comprising inner leg means adapted to engage the inner surface of a golf bag, and an outer leg means adapted to engage the outer surface of a golf bag; and a golf club shaft support means located on the outer leg means of at least one of the bag-grippers.

6. The golf club organizer of claim 5, wherein said golf club shaft support means comprises a channel structure that includes two spaced flanges having arcuate facing surface, whereby the channel structure is adapted to partially encircle the shaft of a golf club.

7. The golf club organizer of claim 6, wherein said flanges are resilient.

8. The golf club organizer of claim 7, wherein each said channel structure is a molded structure integral with the outer leg means of the associated bag-gripper.

9. A golf club organizer adapted to be mounted on a golf bag, comprising:

a bendable elongated strip adapted for disposition above the upper edge of a golf bag; mounting means extending from said strip for engagement with an upper edge of a golf bag so that said bendable strip can have its major plane conforming to the contour of the bag upper edge; and a series of golf head retention pockets spaced along said elongated strip; said elongated strip having an upper edge; each of said pockets comprising a slot in said upper edge, and a finger extending angularly from said strip so that a terminal portion of the finger is offset from the major plane of the strip in alignment with the associated slot, each of said fingers being located inwardly from the major plane of said strip when the strip is mounted on a golf bag, whereby a golf club can be suspended within the associated golf bag, with the club head resting on an upwardly-facing edge of a slot, and the heel of the club head engaged against the offset terminal portion of the associated finger.

10. The golf club organizer of claim 9, and further comprising an additional finger extending angularly from said strip along one edge of each of said slots; each of said additional fingers having a terminal end portion offset from the major plane of the strip in an opposite direction from the first mentioned finger, so that each additional finger is located outwardly from the strip major plane when the strip is mounted on a golf bag; whereby said additional fingers are adapted to engage the front faces of golf club heads positioned in said slots.

* * * * *